US010053980B2

(12) United States Patent
Godager

(10) Patent No.: US 10,053,980 B2
(45) Date of Patent: Aug. 21, 2018

(54) BOREHOLE STRESS METER SYSTEM AND METHOD FOR DETERMINING WELLBORE FORMATION INSTABILITY

(71) Applicant: SENSOR DEVELOPMENTS AS, Sandefjord (NO)

(72) Inventor: Øivind Godager, Sandefjord (NO)

(73) Assignee: HALLIBURTON AS, Tananger (NO)

( * ) Notice: Subject to any disclaimer, the term of this patent is extended or adjusted under 35 U.S.C. 154(b) by 33 days.

(21) Appl. No.: 14/671,047

(22) Filed: Mar. 27, 2015

(65) Prior Publication Data

US 2016/0281499 A1 Sep. 29, 2016

(51) Int. Cl.

| | |
|---|---|
| ***E21B 49/00*** | (2006.01) |
| ***E21B 47/06*** | (2012.01) |
| ***E21B 47/12*** | (2012.01) |
| ***E21B 47/01*** | (2012.01) |

(52) U.S. Cl.

CPC ..... *E21B 49/006* (2013.01); *E21B 47/01* (2013.01); *E21B 47/011* (2013.01); *E21B 47/06* (2013.01); *E21B 47/065* (2013.01); *E21B 47/12* (2013.01)

(58) Field of Classification Search

CPC ..... E21B 47/0006; E21B 47/01; E21B 47/06; E21B 47/12; E21B 49/003; E21B 49/006; G01L 7/16; G01L 7/18

USPC ..... 73/152.46, 152.51, 152.52

See application file for complete search history.

(56) References Cited

U.S. PATENT DOCUMENTS

| | | | | |
|---|---|---|---|---|
| 4,149,409 A | | 4/1979 | Serata | |
| 4,193,307 A | * | 3/1980 | Baker | E21B 33/0355 73/701 |
| 4,596,151 A | | 6/1986 | Allwes | |
| 4,744,245 A | * | 5/1988 | White | E21B 43/26 166/250.09 |
| 4,776,218 A | * | 10/1988 | Sawa | G01L 13/025 338/4 |

(Continued)

FOREIGN PATENT DOCUMENTS

| | | |
|---|---|---|
| GB | 2466862 A | 7/2010 |
| GB | 2475911 A | 6/2011 |

(Continued)

OTHER PUBLICATIONS

International Search Report and Written Opinion of the International Searching Authority for Application No. PCT/IB2016/051702 dated Jun. 2, 2016, 11 pages, ISR/EP.

(Continued)

*Primary Examiner* — Benjamin Schmitt

(74) *Attorney, Agent, or Firm* — Haynes and Boone, LLP

(57) ABSTRACT

A Wellbore stress meter system and method for determining wellbore formation instability, comprising a first load cell, a first pressure sensor with a pressure output signal, a wireless communication system, a cable, and a surface device, said first load cell comprises; a second pressure sensor with a stress output signal, a cell element comprising a fluid, a first interface element in a first end of said first load cell with fluidly separated first and second surfaces wherein said first surface is in fluid communication with said fluid, and said first interface element moves relative said cell element as a function of a force applied on said first surface, and compresses said fluid acting on said second pressure sensor.

20 Claims, 6 Drawing Sheets

(56) References Cited

U.S. PATENT DOCUMENTS

| | | | | |
|---|---|---|---|---|
| 4,893,505 | A * | 1/1990 | Marsden | E21B 47/06 374/E1.004 |
| 5,285,692 | A | 2/1994 | Steiger et al. | |
| 5,471,882 | A * | 12/1995 | Wiggins | G01L 9/0022 73/152.52 |
| 5,789,669 | A * | 8/1998 | Flaum | E21B 49/10 73/152.51 |
| 6,102,122 | A | 8/2000 | De Rouffignac | |
| 6,138,752 | A | 10/2000 | Bass et al. | |
| 2007/0292071 | A1 * | 12/2007 | Zerwekh | E21B 47/06 385/12 |
| 2008/0060846 | A1 * | 3/2008 | Belcher | E21B 17/042 175/25 |
| 2012/0017673 | A1 * | 1/2012 | Godager | E21B 41/0085 73/152.51 |
| 2012/0173216 | A1 | 7/2012 | Koepsell et al. | |
| 2014/0284050 | A1 * | 9/2014 | Jacob | E21B 47/011 166/250.01 |
| 2015/0007976 | A1 | 1/2015 | Godager | |

FOREIGN PATENT DOCUMENTS

| | | | |
|---|---|---|---|
| WO | WO 2000/049268 | A1 | 8/2000 |
| WO | WO 2010/037729 | A1 | 4/2010 |

OTHER PUBLICATIONS

Office Action issued for Norwegian Patent Application No. 20150384, dated Oct. 20, 2017, 3 pages.

* cited by examiner

BOREHOLE STRESS METER SYSTEM AND METHOD FOR DETERMINING WELLBORE FORMATION INSTABILITY

BACKGROUND OF THE INVENTION

Field of the Invention

The present invention relates to the technical field of stress measurements of a wellbore. More specifically it relates to the field of determining wellbore formation instability by measuring stress outside a wellbore conduit and analysing resulting stress parameters.

Description of Prior Art

Instabilities in wellbores can have serious consequences, such as fracturing or collapse of the wellbore. Instabilities can be caused by changes in the surrounding formation due to e.g. erosion, and washout which will again lead to in-situ stresses. In some wellbores, and especially wellbores with casing strings cemented in place, the stresses may build up over time, apparently without influencing drilling operations. However, due to e.g. washout and erosion outside the casing wall, stresses may build up, leading to a potentially dangerous situation. Collapse of a wellbore can have both large economic and environmental consequences. It is therefore important to monitor and analyze changes in stresses outside the casing to be able to prevent such situations from happening as a result of instabilities.

The formation surrounding an oil well may be composed of different materials, typically rock and sediments, as well as fluids.

When a load is applied to the formation, it is carried by the solid particles as well as the fluid in the pores. The flow rate of the fluid depends on the permeability of the formation, whereas the strength and compressibility of the soil depend on the stresses between the solid particles of the formation.

The total vertical stress acting at a point in the formation is due to forces from any material or water above the point, i.e. particles, water, and other loads.

Vertical stress will be related to horizontal stress through complex relationships, and changes in the vertical stress will influence the horizontal stress and vice-versa.

Local formation changes and instabilities can be caused by changes in total stress, e.g. changes in load due to depletion of nearby reservoirs etc.

However, these formation changes and instabilities can also be caused by changes in pore pressures.

As an example, consider sand that initially is damp. It will remain intact because the pore pressure is initially negative, but as it dries, this pore pressure suction is lost and it collapses.

It is therefore not sufficient only to understand how the total stress is acting on the formation. More importantly, the combinatory effect that total stress and pore pressure should be used when analysing e.g. stability of the formation. This combined parameter is termed effective stress and it is given as the difference between the total stress and the pore pressure.

Effective stress controls shear strength, compression, distortion changes in strength, changes in volume, changes in shape etc. of the formation.

Effective stress represents the distribution of load carried by the soil over the area considered.

Total and effective stresses should be handled separately. Movements and instabilities can be caused by changes in total stress, such as loading by foundations and unloading due to slides. They can also be caused by changes in pore pressure. Sudden changes in wellbore stress may be caused by sudden fluid movements on the outside of the wellbore, thermal stress with time that is induced by either production of injection, sudden change in overburden pressures, compactions of formation related to depletion of underlying formations, etc.

The critical shear strength of the formation is a function of the effective normal stress and a change in the effective stress will lead to a change in strength.

In US patent application 2012173216 A1 logging data from geophysical surveys are used to determine stresses in the wellbore for the purpose of discovering subterranean assets.

U.S. Pat. No. 5,285,692 describes calculation of mean effective stress around the wellbore using geostatic overburden in situ stress, the field pore pressure and the total stress around the wellbore based on shale cuttings.

Various methods exist for collecting data from an in-situ location. GB 2466862 A describes in situ measurements of wellbore and formation parameters, and communication of the signals over a wireless link.

However, the problem remains of how to effectively provide continuous determination of wellbore stability in a specific area of a wellbore based on analysis of real measurements.

SUMMARY OF THE INVENTION

The main object of the invention is to provide a system and a method for early determination of instabilities and changes in its structural integrity which can have serious consequences, such as fracturing or collapse of the wellbore.

A further object of the invention is to provide reliable instrumentation that can be permanently installed in the wellbore without requiring any maintenance.

A further object of the present invention is to solve the problems related to prior art described above and therefore to disclose a stress meter taking account of the effective stresses of the formations close to a wellbore.

A further object of the present invention is to solve the problems related specifically wellbores with a casing string cemented in place, where changes in stresses outside the casing not directly influences the drilling operation initially.

The invention is a wellbore stress meter system comprising;

a first load cell, a first pressure sensor with a pressure output signal, a wireless communication system comprising an external device and an internal device, a cable, and a surface device, wherein said first load cell, said first pressure sensor and said external device are configured to be arranged outside said wellbore conduit, and said internal device and said cable are configured to be arranged inside said wellbore conduit, wherein said first load cell comprises;

- a second pressure sensor with a stress output signal,
- a cell element comprising a first fluid with a first fluid pressure,
- a first interface element arranged in a first end of said first load cell with fluidly separated first and second surfaces, wherein said first surface is in fluid communication with said first fluid, and said first interface element is further configured to move relative said cell element as a function of a first force applied on said first surface relative a second end opposite said first end, and to compress said first fluid acting on said second pressure sensor, wherein said wellbore stress meter system is arranged to transfer said stress output signal and said pressure output signal, to said surface device via said wireless communication system and said cable.

An increase in the pore pressure will reduce the effective stress and therefore the strength of the formation, which may lead to instabilities or collapse.

By measuring both load and pore pressure changes over time it is possible to determine whether the changes are related to changes in the local formation/rock, or changes in other areas along the wellbore.

The invention is also a method for determining a wellbore formation instability, comprising the steps of; —arranging a first pressure sensor with a pressure output signal and a first load cell (10) as described above in an investigation interval outside a wellbore conduit, transmitting wirelessly said stress output signal and said pressure output signal across a wall of said wellbore conduit and further via cable inside said wellbore conduit to a surface device, wherein said method comprises the steps of in said surface device;

recording first values for said stress output signal and said pressure output signal, -periodically reading next values for said stress output signal and said pressure output signal, and detecting a wellbore formation instability based on a difference between said next values and said first values.

BRIEF DESCRIPTION OF THE DRAWINGS

The attached figures illustrate some embodiments of the claimed invention.

EMBODIMENTS OF THE INVENTION

The invention will in the following be described and embodiments of the invention will be explained with reference to the accompanying drawings.

Figure 1:
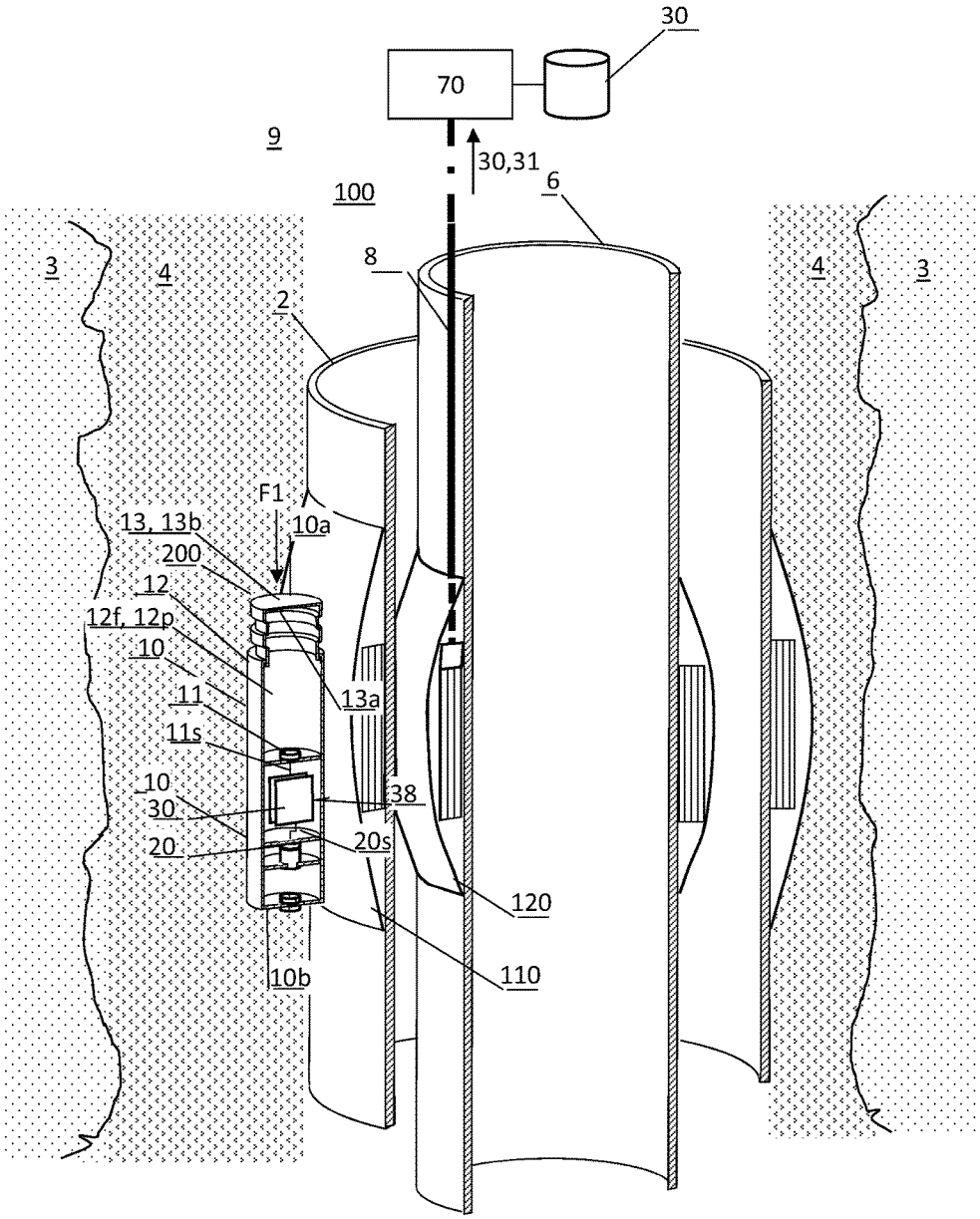
FIG. 1 illustrates in a section view an embodiment of a wellbore stress meter system (9) according to an embodiment of the invention arranged in a wellbore.

FIG. 1 illustrates in an embodiment the invention, where a casing or tubing string (2) is installed in a wellbore (100).

Figure 2:
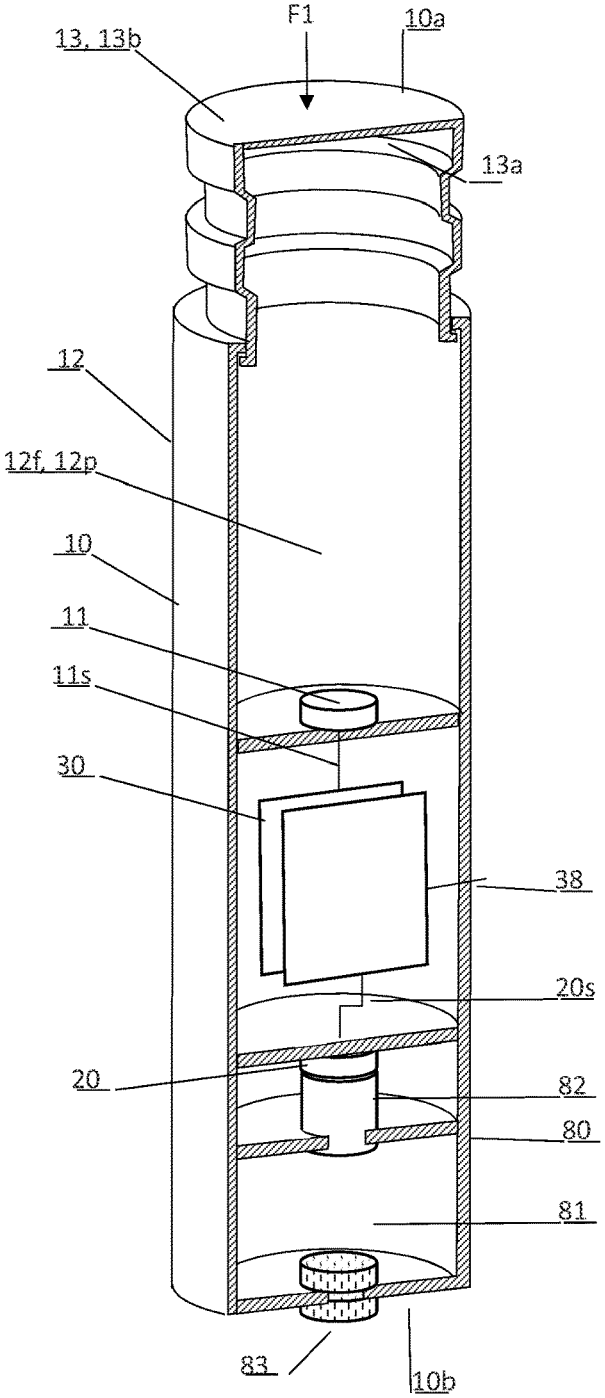
FIG. 2 illustrates a more detailed section view of the load cell (10) in FIG. 1.

A first load cell (10) and a first pressure sensor (20) are arranged outside the casing (2). FIG. 2 shows these elements in an enlarged drawing.

The first load cell (10) comprises a second pressure sensor (11) with a stress output signal (11*s*), a cell element (12) comprising a first fluid (12*f*) with a first fluid pressure (12*p*). The first fluid (12*f*) cannot be seen directly in the figure. However, according to the invention, the space inside the cell element (12) is filled up with this fluid.

Further, the first load cell (10) comprises a first interface element (13) arranged in a first end (10*a*) of the first load cell (10) with fluidly separated first and second surfaces (13*a*, 13*b*,), where the first surface (13*a*) is in fluid communication with the first fluid (12*f*), and the first interface element (13) is further configured to move relative the cell element (12) as a function of a first force (F1) applied on the first surface (13*a*) relative the second end (10*b*). In this embodiment the first interface element (13) is a piston arranged to move in a longitudinal direction relative the load cell (10), so that a positive force (F1) will push the first interface element (13) into the cell element (12). This will increase the first fluid pressure (12*p*) inside the cell element (12) where the second pressure sensor (11) is arranged, and the stress output signal (11*s*), will increase. Since fluids in general, and also the first fluid (12*f*), are compressible, the stress output signal (11*s*) will reflect compression of the load cell due (10) due to increased stress in the surrounding material in the longitudinal direction of the load cell.

The wellbore stress meter system (9) further comprises a first pressure sensor (20) with a pressure output signal (20*s*) as illustrated in the lower end of the load cell (10).

The first load cell (10) and the first pressure sensor (20) have to be arranged outside the casing (2) where the measurements are taking place.

In an embodiment the wellbore stress meter system (9) comprises a wireless communication system (100) comprising an external device (110) and an internal device (120). It also comprises a cable (130) and a surface device (70).

The external device (110) is configured for being arranged outside the casing (2) in vicinity of the load cell (10) and the first pressure sensor (20) and transmit the stress output signal (11*s*) and the pressure output signal (20*s*) to the internal device (120) that further communicates with the surface device (70) over the cable (130). The cable (130) is arranged to run inside the wellbore conduit (2).

There are certain problems related to the installation of a cable (9) outside the wellbore conduit (2) that may prevent detection of instabilities. If a cable is run alongside the wellbore conduit or casing, it will be subject to stress and strain if the masses outside the conduit slide or move relative the conduit. When the area surrounding the conduit is filled with cement, the problems may increase even further. According to an embodiment of the invention the cable therefore runs along the tubing (6) and wireless transfer is used for both power supply and signal communication between the housing (80) and the surface device (70).

In an alternative embodiment the cable and the internal device (120) runs along a wireline inside the wellbore conduit (2).

Although the load cell (10) and the external device (120) may also be displaced relative the internal device (110) on the tubing or wireline, the wireless link will operate within a certain range of displacement.

In an embodiment the wireless communication is established by inductive fields, and the external and internal devices (110, 120) comprises inductive elements such as coils to establish a magnetic field between the devices.

According to an embodiment the external device (110) comprises a first E-field antenna (11), and the internal device (120) comprises a second E-field antenna (21), wherein the first antenna, and the second antenna are arranged for transferring a signal between a first connector of the first E-field antenna and a second connector of the second E-field antenna by radio waves (Ec). The first and second E-field antennas comprises dipole antennas or a first toroidal inductor antennas. The E-field transmission allows less stringent alignment of the first and second antennas, which can reduce the time and cost needed for completion of the wellbore, and allow operation over a wider range of displacement between the external and internal devices (110, 120) due to displacement as described above.

To improve signal transmission between the two devices, the wellbore conduit (2) has in an embodiment a relative magnetic permeability less than 1.05 in a region between the and external and internal devices (110, 120).

In an embodiment the cell element (12), i.e., the main part of the load cell (10) is configured for being fixed to the wellbore conduit (2). In this configuration the load cell will detect stresses relative to the conduit (2).

Figure 3:
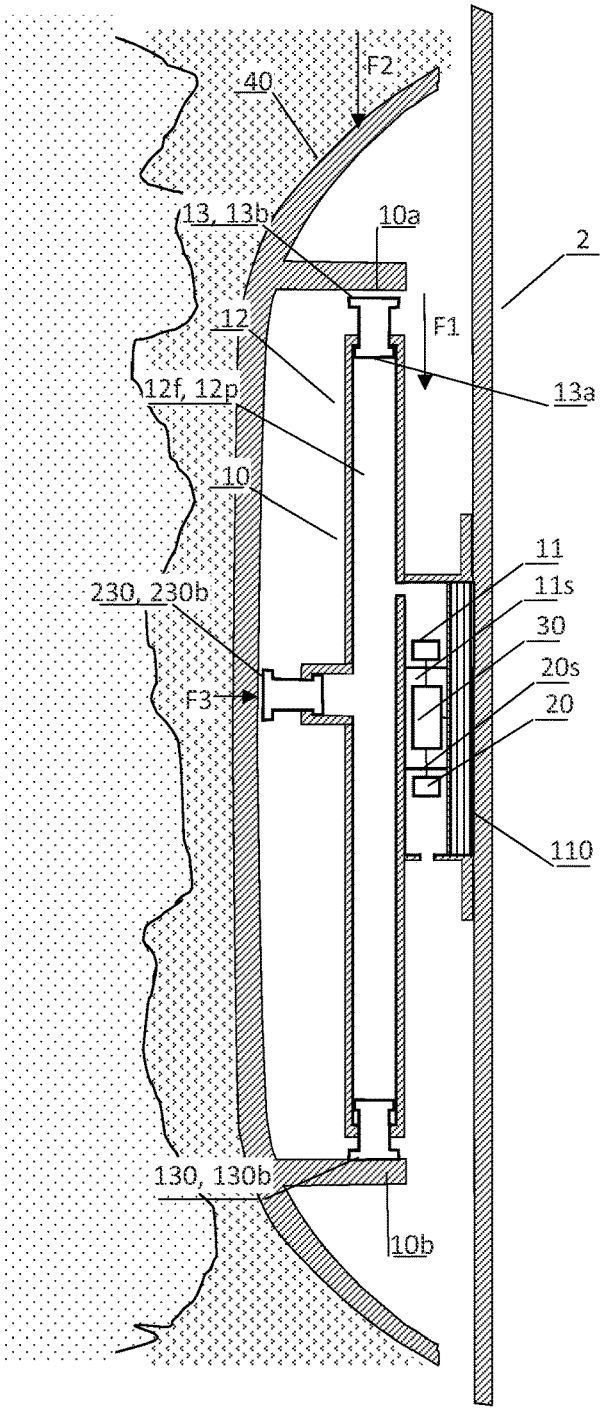
FIG. 3 illustrates a triple acting load cell (10) with a sleeve (40) acting on the load cell according to an embodiment of the invention.

In an embodiment illustrated in FIG. 3, the wellbore stress meter system (9) comprises a focal stress receptacle (40) configured for being arranged in the investigation interval and housing the first load cell (10), wherein the focal stress receptacle (40) is configured to act on the second surface (13*b*) of the first interface element (13) with the first force (F1) when the focal stress receptacle (40) is subject to a second force (F2) from surrounding masses in the investigation interval. In the embodiment shown in FIG. 3, the focal stress receptacle (40) is a sleeve about the conduit (2) that can move in the longitudinal direction of the conduit (2). However, it is fixed to the local masses surrounding it, and any changes in the surrounding masses relative the conduit will move the receptacle up or down. When the receptacle (40) is forced down by the second force (F2), it will push down the first interface element (13), and a change in stress will be detected.

In the section view of FIG. 3, a triple acting load cell with three interface elements (13, 130, 230). Two of the interface elements are arranged opposite each other. In this way stress changes are detected both when the receptacle (40) moves up and down. The third interface element (230) is arranged perpendicular to the other interface elements and will detect stress changes in a first lateral direction.

In an embodiment an additional interface element is are arranged opposite the third interface element (230) to detect stresses opposite the first lateral direction. Such additional interface element could e.g. be arranged outside the other side of the wellbore conduit (2) and in fluid connection with the cell element (12).

In an embodiment one or two further additional interface elements are arranged perpendicular to the first and third interface elements (13, 230) to detect transversal stresses perpendicular to the first lateral direction.

Casing strings are often cemented in place in the wellbore. In an embodiment the focal stress receptacle (40) is also arranged to be cemented in place outside the wellbore conduit (2).

In an embodiment the first interface element (13) is a bellows or a diaphragm. This embodiment is not shown in the drawings, but instead of using pistons as described previously, bellows may be arranged on the first end (10*a*) of the load cell (10). The bellows and the first fluid (12*f*) will be compressed under the first force (F1), and the second pressure sensor (11) will transform the first pressure (12*p*) to a stress output signal (11*s*).

In an embodiment the second pressure sensor (11) is a quartz pressure sensor. With a quartz pressure sensor, good long-term stability and accuracy is obtained, which is advantageous when determination of instability over long periods of time, such as the entire lifetime of the wellbore.

Due to differences in temperature in the surrounding investigation interval, e.g. cement or formation, and the various components of the wellbore stress meter system (9), as well as different coefficients of thermal expansion of the involved materials, e.g. cement, steel, hydraulic fluid etc., the measurements will suffer from thermic noise. The root source of the thermic noise is usually rapid changes in the temperature of the fluids inside the wellbore conduit (2). Thus, as an example, the load cell (10) may experience a force that is due to differences in thermal expansion of the cement and the steel of the load cell, which is not caused by a change in stress of the surrounding formation, but rather caused by temperature changes. Similar thermal noise may be induced on the interface between the steel of the load cell and the fluid inside the load cell.

To solve this problem the invention comprises in an embodiment a temperature sensor. The temperature sensor may be integrated with the first pressure sensor (20) in the form of a quartz pressure and temperature transducer.

The stress output signal (11*s*) may therefore in an embodiment be corrected based on a pre-determined relation between a temperature measured by the temperature sensor arranged in the investigation interval and the stress output signal (11*s*). The relation can be pre-determined as a static function when the volume of the fluid in the load cell can be regarded as constant, and the load cell is buried in the surrounding cement.

This function may therefore be pre-determined by arranging the load cell inside a block of cement, varying the temperature, and recording a variation in the stress output signal (11*s*) as a function of the applied temperature variation around an operational temperature before the load cell is arranged in the wellbore. In this way the stress output signal (11*s*) may be corrected based on the super position principle, i.e. subtracting the temperature induced contribution at a given temperature.

In an embodiment the pressure output signal (20*s*) is corrected based on the same principle as above, i.e. characterisation and super position principle.

Figure 4:
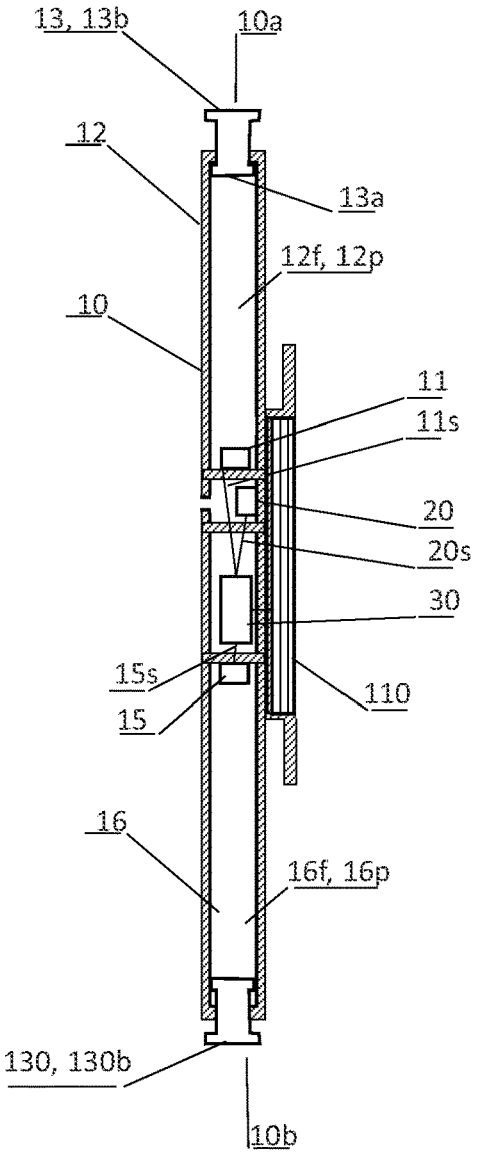
FIG. 4 illustrates in a combined sectional view and block diagram, a double acting load cell (10) with separate sensors and an external device (110) for wireless communication according to an embodiment of the invention.
Figure 5:
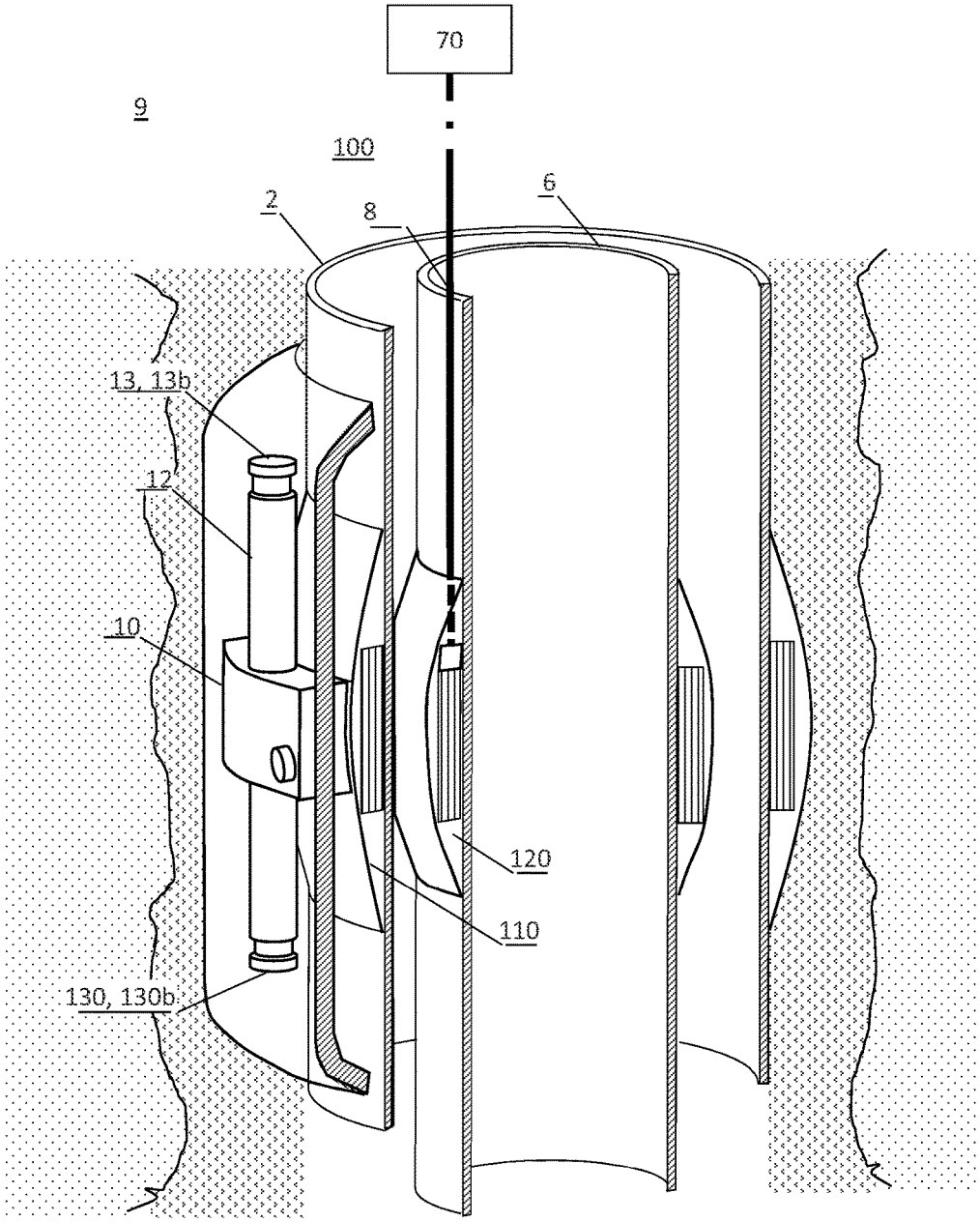
FIG. 5 is a sectional view of a double acting load cell (10) covered by a sleeve (40), where the sleeve is shown transparent and without details regarding how the sleeve acts on the load cell. It also illustrates a wireless communication system (100) according to an embodiment of the invention.

As described above, the load cell (10) may be double acting or triple acting as illustrated in FIGS. 3 and 4. In the embodiment with a double acting load cell, the first load cell (10) comprises a second interface element (130) arranged in the second end (10*b*) of the first load cell (10) with fluidly separated first and second surfaces (130*a*, 130*b*,) wherein the first surface (130*a*) is in fluid communication with the first fluid (12*f*), and the second interface element (130) is further configured to move relative the cell element (12) as a function of the first force (F1). The third interface element (230) is configured to move relative the cell element (12) as a function of a third force (F3).

The triple acting load cell (10) illustrated in FIG. 3, and the double acting load cell in FIG. 4 shows that the first fluid (12*f*) is compressed and acting on the second pressure sensor (11) independently of the direction of the first force (F1). Thus, the value of the stress output signal (11*s*) will be the same whether the first interface element (13) or the second interface element (130), or alternatively the third interface element (230) is pushed into the cell element (12), since the pressure detected by the sensor (11) will be the same.

In an embodiment the focal stress receptacle (40) is configured to move transversally relative the wellbore conduit (2) and act on a second surface (230*b*) of the third interface element (230) with the third force (F3) when the focal stress receptacle (40) is subject to a corresponding transversal force from surrounding masses in the investigation interval.

In an embodiment the wellbore stress meter system (9) comprises a pressure sensor housing (80), comprising the first pressure sensor (20) with the output pressure signal (20*s*), a first oil filled chamber (81), a pressure transfer means (82) between the first oil filled chamber (81) arranged to isolate the first pressure sensor (20) from the oil filled chamber (81), and a pressure permeable filter port (83) through a wall of the housing (80), wherein the pressure permeable filter port (83) is in hydrostatic connectivity with the first oil filled chamber (81). The proposed pore pressure sensor described here allows in-situ determination of a pore pressure without having to establish a fluid connection between the pressure gauge and the formation by perforating the cement according to prior art. In addition the first pressure sensor (20) is isolated from the fluid and little exposed to clogging.

In an embodiment the pressure sensor housing (80) is integrated with the first load cell (10) as illustrated in FIGS. 1, 2 and 3. Thus, one single transducer with two quartz elements can be used to measure both stress and pore pressure in the surrounding formation.

In an embodiment the wellbore stress meter system (9) comprises a signal processing unit (30) configured for being arranged in the investigation interval, receiving the stress output signal (11*s*) and pressure output signal (20*s*), and sending the stress output signal (11*s*) and pressure output signal (20*s*) to a communication port (38) on the signal processing unit (30). The signal processing unit (30) may also be integrated in the transducer as illustrated in FIGS. 1, 2 and 3.

The signal processing unit (30) as shown, is arranged for modulating the stress output signal (11*s*) and the pressure output signal (20*s*) onto a common carrier signal on the communication port (38).

In an embodiment the wellbore stress meter system (9) is configured to transfer power from the surface device (70) to the internal device (120), the internal device (120) configured for generating a varying electromagnetic field from the power, and the external device (110) is configured to provide power to the signal processing unit (30) by power harvesting the varying electromagnetic field. In this embodiment the external device may comprise a separate power unit responsible for power harvesting and power control to the components of the system, such as the pressure sensors (11, 20) and the signal processing unit (30).

Figure 6:
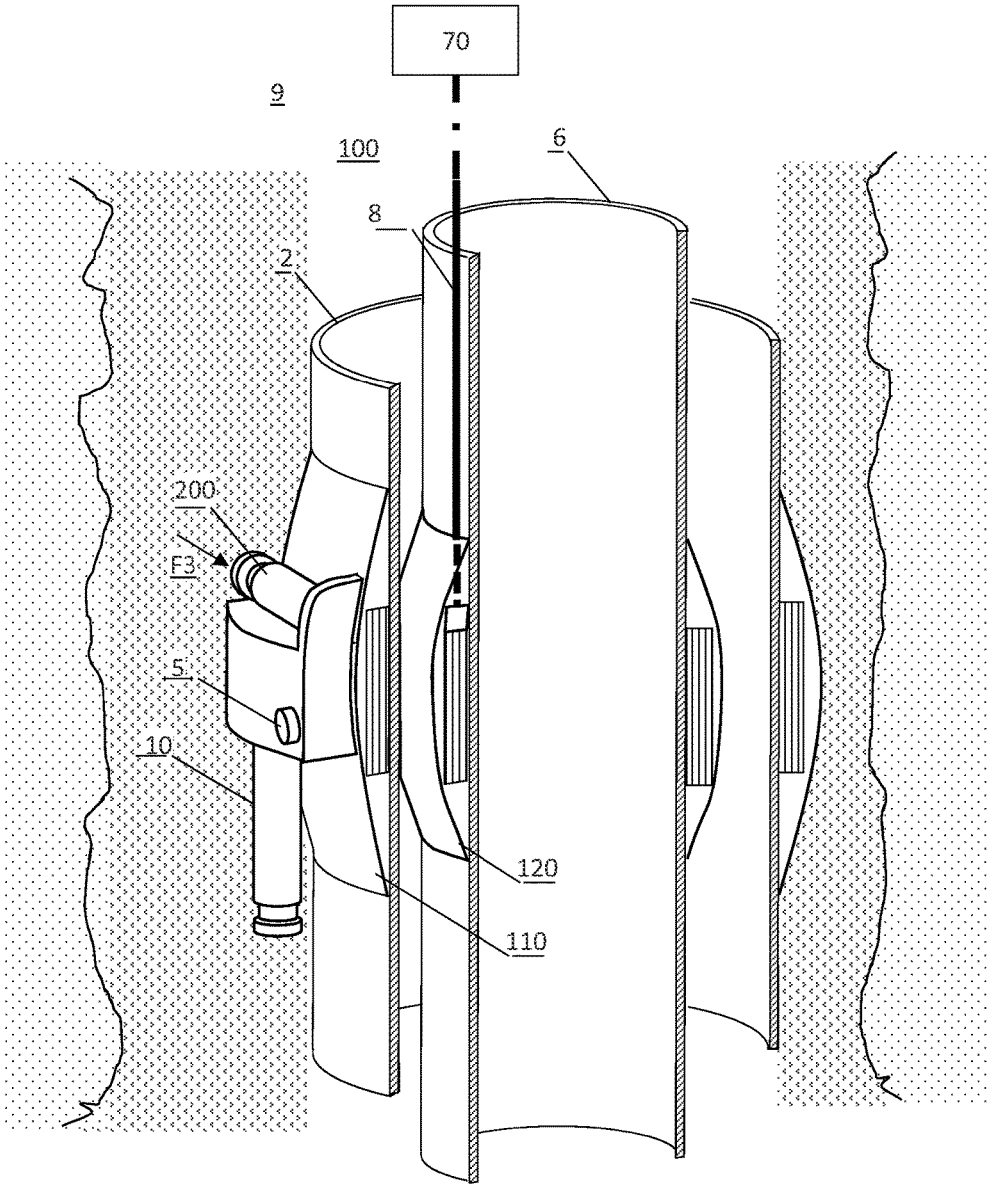
FIG. 6 is a sectional view of wellbore stress meter system (9) with two or more perpendicular load cells (10) It also shows a wireless communication system (100) according to an embodiment of the invention.

The wellbore stress meter system (9) comprises in an embodiment a second load cell (200) arranged perpendicular to the first load cell (10) as illustrated in FIG. 6, arranged to detect a third force (F3) acting on the second load cell (200), wherein the third force (F3) is perpendicular to the first force (F1). This second load cell (200) will measure stresses perpendicular to the first load cell (10).

In an embodiment a second stress output signal (211*s*) from the second load cell (200) is connected to the signal processing unit (30), and the signal processing unit (30) is configured for receiving the second stress output signal (211*s*) and sending the second stress output signal (211*s*) to the communication port (38) on the signal processing unit (30), in a similar way as for the first stress output signal (11*s*) for the first load cell (10).

According to an embodiment the surface processing device (70) is configured for;

recording first values (30) for the stress output signal (11*s*) and the pressure output signal (20*s*), periodically reading next values (31) for the stress output signal (11*s*) and the pressure output signal (20*s*), and detecting a wellbore formation instability based on a difference between the next values (31) and the first values (30).

First values (30) are illustrated in FIG. 1 as a database, but they can be stored in any suitable format. New values will be read continuously and compared to the stored values. The new values will in an embodiment also be stored, and historic data will be available for the stability of the wellbore formation in the investigation interval.

In an embodiment the surface processing device (70) is configured to raise an alarm when a predefined value has been reached for the new value with respect to the stored values.

The wellbore stress meter system (9) comprises in an embodiment an additional third load cell arranged perpendicular to both the first and second load cells (10, 200). This has not been show in the drawings. In this configuration the wellbore stress meter system (9) will detect stresses in three individually perpendicular directions.

It should be noted that only one first pressure sensor (20) is needed, independently of the number of load cells (10, 200, 300) as long as the load cells are located in the same area, since the pore pressure is not a directional value. Therefore transducers with different number of load cells and a single pore pressure sensor may be manufactured according to the invention, where one example is given in FIG. 6 for two load cells.

It should also be noted that the second and third load cells (200, 300) may also be double acting as described for the first load cell (10).

In an alternative embodiment to the double acting load cells with a single cell element (12) and single second pressure sensor (11), the double acting load cell (10) comprises a third pressure sensor (15) with a second stress output signal (15*s*), a second cell element (16) comprising a second fluid (16*f*) with a second fluid pressure (16*p*) as illustrated in FIG. 4. The second cell element (16) is isolated from the first cell element (12), and the each of the fluid elements (12*f*, 16*f*) are acting on a dedicated sensor with a sensor signal that is sent to the signal processing unit (30). In the case where the load cell (10) is fixed to the wellbore conduit (2), this will give an indication of the direction of the force acting on the load cell. The double sensor load cells may be used in perpendicular pairs or triples as described above.

The method according to the invention has already been described above, and that description forms the basic embodiment. First values (30) are illustrated in FIG. 1 as a database, but they can be stored in any suitable format. New values will be read continuously and compared to the stored values. The new values will in an embodiment also be stored, and historic data will be available for the stability of the wellbore formation in the investigation interval.

In an embodiment the method comprises raising an alarm when a predefined value has been reached for the new value with respect to the stored values.

In a further embodiment the method comprises the step of providing power from the surface device (70) via cable (8) downhole inside the wellbore conduit (2) and further via wireless transmission through the wall of the wellbore conduit to the first and second pressure sensors (20, 11).

In a wellbore there is not necessarily a direct relationship between the pore pressure and the effective stress in a location. Changes in the load may be related to events above or below the investigation interval, but the changes are registered as a change in load along the wellbore. This change in load may result in sliding of the conduit relative the wellbore formation, which again may result in damages and breakdown of the cementing.

The detection of the changes in the stability of the wellbore can be a relative measure, and it is not necessarily an object to obtain correct values from the stress or the pore pressure measurements.

The invention claimed is:

1. A wellbore stress meter system comprising a first load cell, a first pressure sensor with a pressure output signal, a wireless communication system including an external device and an internal device, a cable, and a surface device, wherein said first load cell, said first pressure sensor and said external device are disposed within an investigation interval outside said wellbore conduit, and said internal device and said cable are disposed inside said wellbore conduit, wherein said first load cell includes:

a second pressure sensor with a stress output signal;

a cell element comprising a first fluid with a first fluid pressure; and a first interface element disposed in a first end of said first load cell with fluidly separated first and second surfaces, wherein said first surface is in fluid communication with said first fluid, and said second surface is in operable communication with solid masses in said investigation interval, and said first interface element is longitudinally movable relative said cell element as a function of a first force from said sold masses applied on said first surface relative a second end opposite said first end, and said first fluid is compressible on said second pressure sensor, wherein said second pressure sensor and said first pressure sensor are in communication with said surface device via said wireless communication system and said cable.

2. The wellbore stress meter system according to claim 1, wherein said cell element is fixed to said wellbore conduit.

3. The wellbore stress meter system according to claim 2, further comprising a focal stress receptacle disposed in said investigation interval, said first load cell disposed in said focal stress receptacle, wherein said focal stress receptacle is configured to act on said second surface of said first interface element with said first force when said focal stress receptacle is subject to a second force from surrounding solid masses in said investigation interval.

4. The wellbore stress meter system according to claim 3, wherein said solid masses include cement in said investigation interval and said focal stress receptacle is disposed within said cement such that said stress receptacle is subject to said second force from said cement.

5. The wellbore stress meter system according to claim 1, wherein said cell element is a cylinder and said first interface element is a piston movably disposed inside said cylinder .

6. The wellbore stress meter system according to claim 1, wherein said first interface element is a bellow or a diaphragm.

7. The wellbore stress meter system according to claim 1, wherein said second pressure sensor is a quartz pressure sensor.

8. The wellbore stress meter system according to claim 1, wherein said first pressure sensor is a quartz pressure and temperature transducer.

9. The wellbore stress meter system according to claim 1, wherein said first load cell comprises a second interface element disposed in said second end of said first load cell with fluidly separated first and second surfaces, wherein said first surface is in fluid communication with said first fluid, and said second interface element is movable relative to said cell element as a function of said first force.

10. The wellbore stress meter system according to claim 1, further comprising:

a pressure sensor housing, including said first pressure sensor with said output pressure signal;

a first oil filled chamber;

a pressure transfer means between said first oil filled chamber and said first pressure sensor, wherein said first pressure sensor is isolated from said oil filled chamber by said pressure transfer means, and a pressure permeable filter port through a wall of said housing, wherein said pressure permeable filter port is in hydrostatic connectivity with said first oil filled chamber.

11. The wellbore stress meter system according to claim 10, wherein said housing is integrated with said first load cell.

12. The wellbore stress meter system according to claim 1, further comprising a signal processing unit disposed in an investigation interval and in communication with said second pressure sensor, said first pressure sensor, and a communication port on said signal processing unit.

13. The wellbore stress meter system according to claim 12, wherein said signal processing unit is arranged for modulating said stress output signal and said pressure output signal onto a common carrier signal.

14. The wellbore stress meter system according to claim 1, wherein said wireless link is configured to transfer power from said surface device to said internal device, said internal device configured for generating a varying electromagnetic field from said power, and said external device is configured to provide power to said signal processing unit by power harvesting said varying electromagnetic field.

15. The wellbore stress meter system according to claim 1, comprising a second load cell disposed perpendicular to said first load cell and subject to a third force, wherein said third force is perpendicular to said first force.

16. The wellbore stress meter system according to claim 1, comprising a second load cell disposed perpendicular to said first load cell, and subject to detect a third force, wherein said third force is perpendicular to said first force, wherein said second load cell is in communication with said signal processing unit, and said signal processing unit is in communication with said communication port on said signal processing unit.

17. A method for determining a wellbore formation instability, the method comprising:

arranging a first pressure sensor with a pressure output signal and a first load cell in an investigation interval outside a wellbore conduit, wherein said first load cell includes:

a second pressure sensor with a stress output signal;

a cell element comprising a first fluid with a first fluid pressure;

a first interface element arranged in a first end of said first load cell with fluidly separated first and second surfaces, wherein said first surface is in fluid communication with said first fluid, and said second surface is arranged in operable communication with solid masses in said investigation interval, and said first interface element is longitudinally movable relative said cell element as a function of a first force from said sold masses applied on said first surface relative a second end opposite said first end, and said first fluid is compressible on said second pressure sensor;

transmitting wirelessly said stress output signal and said pressure output signal across a wall of said wellbore conduit and further via a cable inside said wellbore conduit to a surface device;

recording first values for said stress output signal and said pressure output signal;

periodically reading next values for said stress output signal and said pressure output signal; and detecting a wellbore formation instability based on a difference between said next values and said first values for said stress output signal and said pressure output signal.

18. The method for determining a wellbore formation instability according to claim 17, comprising providing power from said surface device via a cable downhole inside said wellbore conduit and further via wireless transmission through said wall of said wellbore conduit to said investigation interval.

19. The method for determining a wellbore formation instability according to claim 18 , wherein said first pressure sensor is a quartz pressure and temperature transducer, and further comprising correcting said stress output signal based on a pre-determined relation between a temperature measured by temperature sensor arranged in said investigation interval and said stress output signal.

20. The method for determining a wellbore formation instability according to claim 19, further comprising the step of initially determining said relation between said temperature measured by temperature sensor disposed in said investigation interval and said stress output signal by arranging said load cell inside a block of cement such that said cement applies said first force to said second surface, varying said temperature, and recording a variation in said stress output signal as a function of said temperature variation.

* * * * *